US010041264B2

(12) United States Patent
Olsen

(10) Patent No.: US 10,041,264 B2
(45) Date of Patent: Aug. 7, 2018

(54) OUTDOOR FOOD PARK FOR USE WITH MOBILE FOOD TRUCKS

(71) Applicant: Mark C Olsen, Salt Lake City, UT (US)

(72) Inventor: Mark C Olsen, Salt Lake City, UT (US)

( * ) Notice: Subject to any disclaimer, the term of this patent is extended or adjusted under 35 U.S.C. 154(b) by 0 days.

(21) Appl. No.: 15/246,828

(22) Filed: Aug. 25, 2016

(65) Prior Publication Data

US 2017/0058543 A1 Mar. 2, 2017

Related U.S. Application Data

(60) Provisional application No. 62/209,845, filed on Aug. 25, 2015.

(51) Int. Cl.

| | |
|---|---|
| ***E04H 3/02*** | (2006.01) |
| ***E01C 13/00*** | (2006.01) |
| ***E01C 15/00*** | (2006.01) |

(52) U.S. Cl.

CPC ..... *E04H 3/02* (2013.01); *E01C 13/00* (2013.01); *E01C 15/00* (2013.01)

(58) Field of Classification Search

CPC ..... E04H 3/02; E01C 13/00; E01C 15/00
USPC ..... 52/6, 7, 8, 103, 106
See application file for complete search history.

(56) References Cited

PUBLICATIONS

Rush, Kris; "Kicks Ahead! Tulsa Welcoming Fuel 66 Food Truck Park on Route 66", May 22, 2016; http://oklahoma.justgoodnews.biz/2016/05/22/tulsa-welcoming-fuel-66-food-truck-park-route-66/.*

Lutostanski, Emilie; "New food truck park plans emerging"; May 13, 2013; https://communityimpact.com/austin/news/2013/05/13/new-food-truck-park-plans-emerging/.*

Fleming, Molly; "Tulsa plans food truck court on Route 66"; May 16, 2016; http://www.fox23.com/news/oklahoma/tulsa-plans-food-truck-court-on-route-66/285769979.*

McCoppin Hub Plaza Is on Its Way to Becoming Open Space, Mar. 28, 2014; http://www.socketsite.com/archives/2014/03/mccoppin_hub_plaza_is_on_its_way_to_becoming_open_space.html (Year: 2014).*

No appeal of decision to allow food trucks at Menlo Caltrain, Feb. 4, 2014; https://www.paloaltoonline.com/news/2014/02/03/menlo-park-no-appeal-of-decision-to-allow-food-trucks-at-caltrain-station (Year: 2014).*

* cited by examiner

*Primary Examiner* — Abigail A Risic
(74) *Attorney, Agent, or Firm* — Pia Anderson Moss Hoyt

(57) ABSTRACT

A food truck park for mobile food trucks provides a destination with a unique atmosphere and improved layout for arranging the food trucks. The food park includes a parking area and a raised pedestrian walkway. The walkway includes extended pier portions that extend into the parking area. The extended pier portions define parking slips for the mobile food trucks. The walkway is raised with respect to the parking area to provide easy access to the service windows of the mobile food trucks. The food truck park may further include electrical hookups for the mobile food trucks.

11 Claims, 6 Drawing Sheets

OUTDOOR FOOD PARK FOR USE WITH MOBILE FOOD TRUCKS

CROSS-REFERENCE TO RELATED APPLICATIONS

This application claims the benefit U.S. Provisional Patent Application No. 62/209,845 filed on Aug. 25, 2015, which application is hereby incorporated by reference in its entirety herein.

STATEMENT REGARDING FEDERALLY SPONSORED RESEARCH OR DEVELOPMENT

Not Applicable.

BACKGROUND OF THE INVENTION

1. The Field of the Invention

The present invention relates generally to outdoor parks, and more particularly, but not necessarily entirely, to outdoor parks for mobile food trucks.

2. Description of Related Art

Mobile food trucks have become increasingly popular with the public for providing fast and convenient food. In most cases, mobile food trucks are operator owned and specialize in a particular cuisine. Mobile food trucks may be entirely self-contained with a mobile kitchen that allows food to be prepared onsite. These trucks may include a service window to allow patrons to order and receive food. The service window may be located at the back or the side of the mobile food truck.

One problem facing mobile food truck operators is finding suitable locations to operate as local jurisdictions often place restrictions on when and where trucks may be parked. Most truck operators rely on unimproved locations to attract pedestrians or local clientele from surrounding businesses. For example, the operators of mobile food trucks often park street-side or onsite at large public or private events. Their have been "food truck roundups" which involve a number of trucks gathering to a common parking lot and attempting to attract people in larger numbers by having multiple trucks for a wider food selection. However, these arrangements are less than desirable as the trucks are noisy with generators and there is no seating and no designed shade for the patrons to enjoy their food. Further, the food trucks often park haphazardly creating a confusing and unaesthetic appearance. In other instances, the food trucks park in a line long a side of a street. Because of the line of trucks stretches over an extended length, It would be an advantage over the prior art to provide a dedicated outdoor space for mobile food trucks that provides a unique atmosphere that incorporates the owner operated food trucks but provides innovations that make it an entirely different experience for both the vendors and the patrons. The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
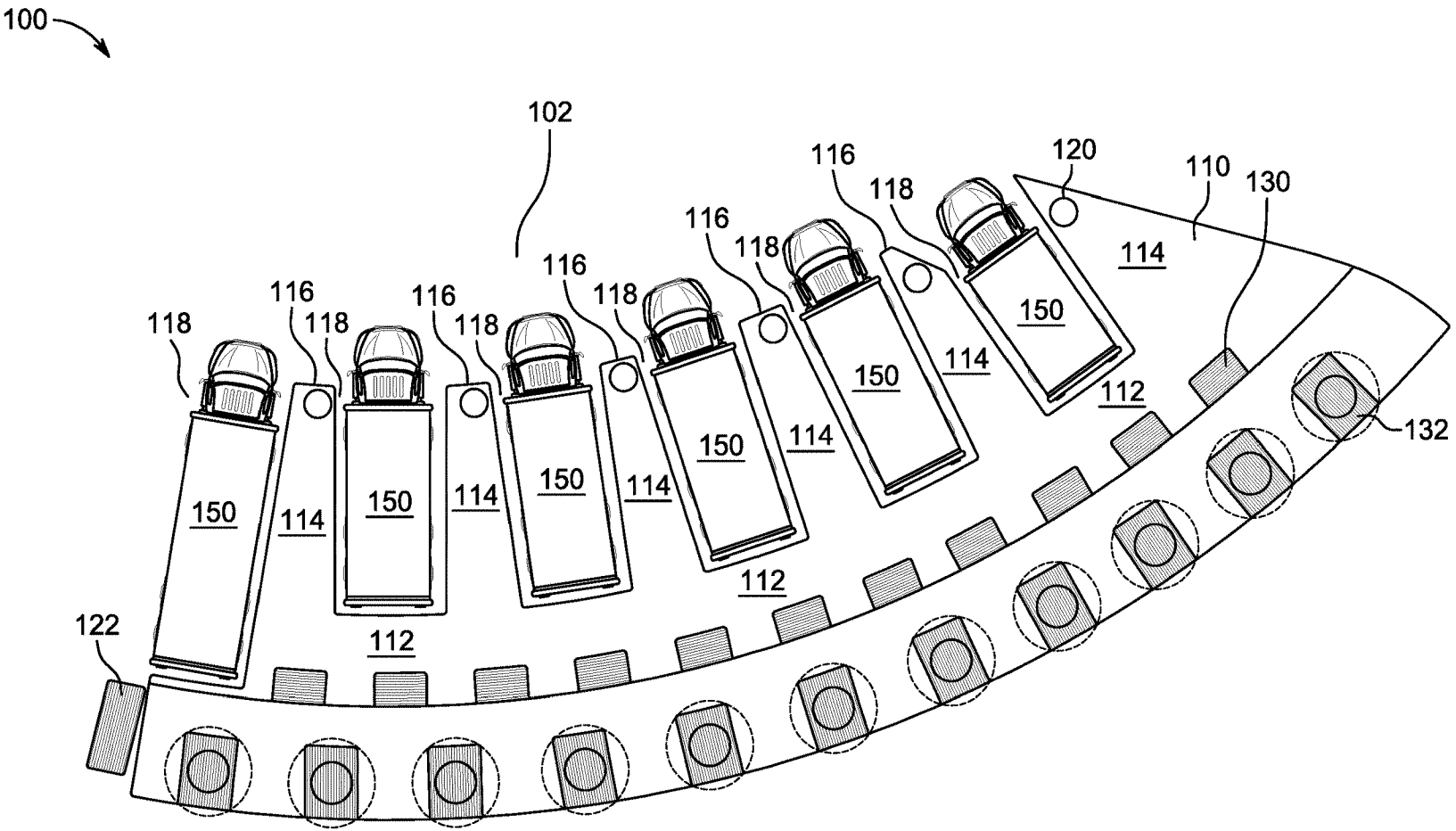
FIG. 1 depicts an outdoor food truck park according to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

As used herein, the term "mobile food truck" includes mobile food trucks, mobile food trailers, and mobile food carts. The mobile food trailers may be one of bumper-pull trailers or fifth-wheel trailers. Like the mobile food trucks, the mobile food trailers and carts are self-contained and include a kitchen area that allows for the preparation of food. The mobile food trailers may further include a service window for serving patrons.

It is an objective of the present disclosure to provide a novel food truck park. The food truck park may include a parking area having a compacted roadway base underlay with a gravel surface. In an embodiment, the compacted roadway base underlay is between five and fifteen inches deep. In an embodiment, the roadway base is about eight inches deep. In an embodiment, the gravel surface is between one inch and ten inches deep. In an embodiment, the gravel surface is about five inches deep. The gravel of the gravel surface may be a dark color, such as black, to facilitate snowmelt.

It is further an objective of the present disclosure to provide a food truck park with a main patron walkway or boardwalk. In an embodiment, the walkway is formed of a suitable material for forming the walkway as known to one of ordinary skill, including one of concrete, rock, pavers, asphalt and wood. If concrete is used, it may be stained a dark color, such as gray or black, to facilitate snowmelt. In an embodiment, the walkway is tiered and comprises a first tiered portion and a second tiered portion. The first tiered portion is raised with respect to the second tiered portion. The first tiered portion of the walkway is adjacent the food truck parking area.

It is further an objective of the present disclosure to provide a walkway with pier portions. The pier portions are raised with respect to the parking area for the food trucks. In an embodiment, the pier portions are raised between four inches and twelve inches, or about seven inches with respect to the parking area. The walkway may be straight or curved. The walkway includes a plurality of extended pier portions that define parking slips for the mobile food trucks. The extended pier portions may extend between eight and fifteen feet away from the main walkway. The width of the extended pier portions is between about four and eight feet. The extended pier portions may taper inward as they extend from the main boardwalk.

In an embodiment, the parking slips are of sufficient width between adjacent ones of the extended portions to receive a single mobile food truck. In an embodiment, the width of the parking stalls is between seven and twelve feet. In an embodiment, the mobile food trucks are either pulled or backed into the parking slips. It will be appreciated that the extended pier portions of the main walkway and the main walkway itself allow patrons to walk on a raised surface beside the mobile food trucks as the mobile food trucks are limited to the lower parking area.

It is further an objective of the present disclosure to provide a food truck park with grading to facilitate drainage. In an embodiment, the first tiered portion is graded away from the parking area. The second tiered portion may also be graded. The first tiered portion and the second tiered portion may be graded about 2%. In an embodiment, the parking area is graded away from the walkway. In an embodiment, the parking area is graded to about 2%.

It is further an objective of the present disclosure to provide a food truck park with seating areas for patrons. In an embodiment, the seating areas comprise picnic tables and benches. In an embodiment, the seating areas comprise circular tables. The food park may also comprise benches and grass areas.

It is further an objective of the present disclosure to provide a food truck park with a plurality of shade structures. The shade structured may be sail-type shade structures. The shade structures may be positioned to maximize shade during particular times of the day, such as when patrons are most likely to visit the food park. In an embodiment, the position of the shade structures may be adjustable to track the movement of the sun throughout the day to maximize shade throughout the day.

It is further an objective of the present disclosure to provide a food truck park with temporary electrical hookups for the mobile food trucks. In an embodiment, each parking slip comprises an electrical hookup. It will be appreciated that the hookups may provide power such that the food trucks do not need to run their generators. In an embodiment, the electrical hookups provide a 50 amp, 220 volt outlet and/or a 20 amp, 110 volt outlet. Each of the outlets may be protected by a GFI as is known to one of ordinary skill. It will be appreciated that these innovations provide a safer, quieter, and an overall better experience for patrons.

It is further an objective of the present disclosure to provide a food truck park that is designed to run year round. The grading of the parking area and the walkway and the dark color of the concrete and gravel assists in melting snow and the removal of water from the public area. In an embodiment, each parking slip has a sump filled with gravel. The sump may be disposed in the center of the stall to help absorb the water that will accumulate from large rain and snow falls. In an embodiment, the food park may comprise an area for erecting a large event tent. Gas or electric heaters may be utilized to provide warm seating areas in cold weather. Unit heaters may be utilized to add ambiance as well as give needed heat.

Referring now to FIG. 1, an outdoor food truck park 100 for mobile food trucks 150 is shown according to an embodiment of the present disclosure. The park 100 may comprise a parking area 102 having an exit to a roadway. The parking area 102 is configured and adapted to allow the passage of vehicles as will be explained in more detail hereinafter. The parking area 102 may include a top surface formed from any suitable material, including road base, asphalt, cement, and gravel.

Adjacent the parking area 102 is a pedestrian walkway 110. In an embodiment, the pedestrian walkway 110 is raised with respect to the level of the parking area 102. In an embodiment, the walkway 110 is raised between two to ten inches with respect to the parking area 102. The walkway 110 may be formed of any suitable material, including concrete, asphalt, wood, gravel, rock, pavers and composite material.

The pedestrian walkway 110 may include a main walkway 112 and a plurality of pier portions 114 that extend into the parking area 102. In an embodiment, the main walkway 112 may have a generally arcuate shape. In an embodiment, the main walkway 112 may be substantially straight. Each of the pier portions 114 extends from a concave side of the main walkway 112 and terminates at a terminal end 116. In an embodiment, the length of the pier portions 114, as measured from the main walkway 112, may be between ten feet and twenty-five feet. In an embodiment, the pier portions 114 may be between four feet and eight feet wide. The pier portions 114 may taper. Because of the arcuate configuration of the main walkway 112, the pier portions 114 may be arranged like the spokes on a wheel.

Adjacent ones of the pier portions 114 define slips 118 for receiving food trucks 150. As shown, a width of the slips 118 is such that each slip 118 can only receive a single food truck 150. In an embodiment, the width of the slips 118 is such that each slip 118 can received two food trucks 150. In an embodiment, a width of each of the slips 118 is between eight feet and twelve feet. In an embodiment, a width of each of the slips 118 is just wide enough to receive a single food truck 150. In an embodiment, the park 100 may have two, three, four, five, six, seven, eight, nine or ten slips for food trucks. In an embodiment, the park 100 may have ten or more slips for food trucks 150.

Located adjacent each of the slips 118 is an electrical hookup 120 that provides a connection to electrical power for food trucks parked in the slips 118. In an embodiment, each of the electrical hookups 120 provides one or more plugs into which an adjacent food truck 150 can connect to power. In particular, food trucks often require electrical power in order to operate appliances, lights, and air conditioners. In the past, in order to provide power onsite, food trucks utilized on board generators. However, with the electrical hookups 120 provided by the present invention, the food trucks 150 are able to connect directly to power while parked in the slips 118 thereby eliminating the need to operate their on-board generators. It will be appreciated that this innovation reduces the noise and exhaust at the park 100.

In an embodiment, each electrical hookup 120 may provide one or more standardized female plugs. The food trucks may connect to power using extension cords that extend between the electrical hookups and the trucks. In an embodiment, the electrical hookups 120 may provide 30 amps or 50 amps of current. Each electrical hookup 120 may be protected by a circuit breaker. A main electrical power supply 122 may distribute power from a public electrical power grid to each of the electrical hookups 120. In an embodiment, the main electrical power supply 122 may distribute power from a large generator to each of the electrical hookups 120.

Located along the walkway 110 may be benches 130 and tables 132. In addition, the park 100 may further include shade devices for providing shade to the benches 130 and tables 132. The shade devices may include umbrellas, canopies, netting, shade fabric, or any other type of structure capable of providing shade. In an embodiment, the shade devices are manually or automatically adjustable to track the movements of the sun to provide maximum shade at any given time of the day.

Referring still now to FIG. 1, food trucks 150 may park in slips 118. In an embodiment, the food trucks 150 may back into the slips 118 or they may pull in forward. It will be appreciated that the food trucks 150 may be independently owned and operated. Once the food trucks 150 have entered the slips 118, they may temporarily connect to power through the electrical hookups 120. This may be done using an extension cord.

Once the food trucks 150 have parked in the slips 118 and connected to power, patrons may utilize the walkway 110 to access the trucks 150. In particular, the patrons may utilize the pier portions 114 to access the service windows on the trucks 150 to order food and interact with the truck operators. It will be appreciated that because the pier portions 114 are raised with respect to the parking area 102, that the patrons are kept out of harms way.

Figure 2:
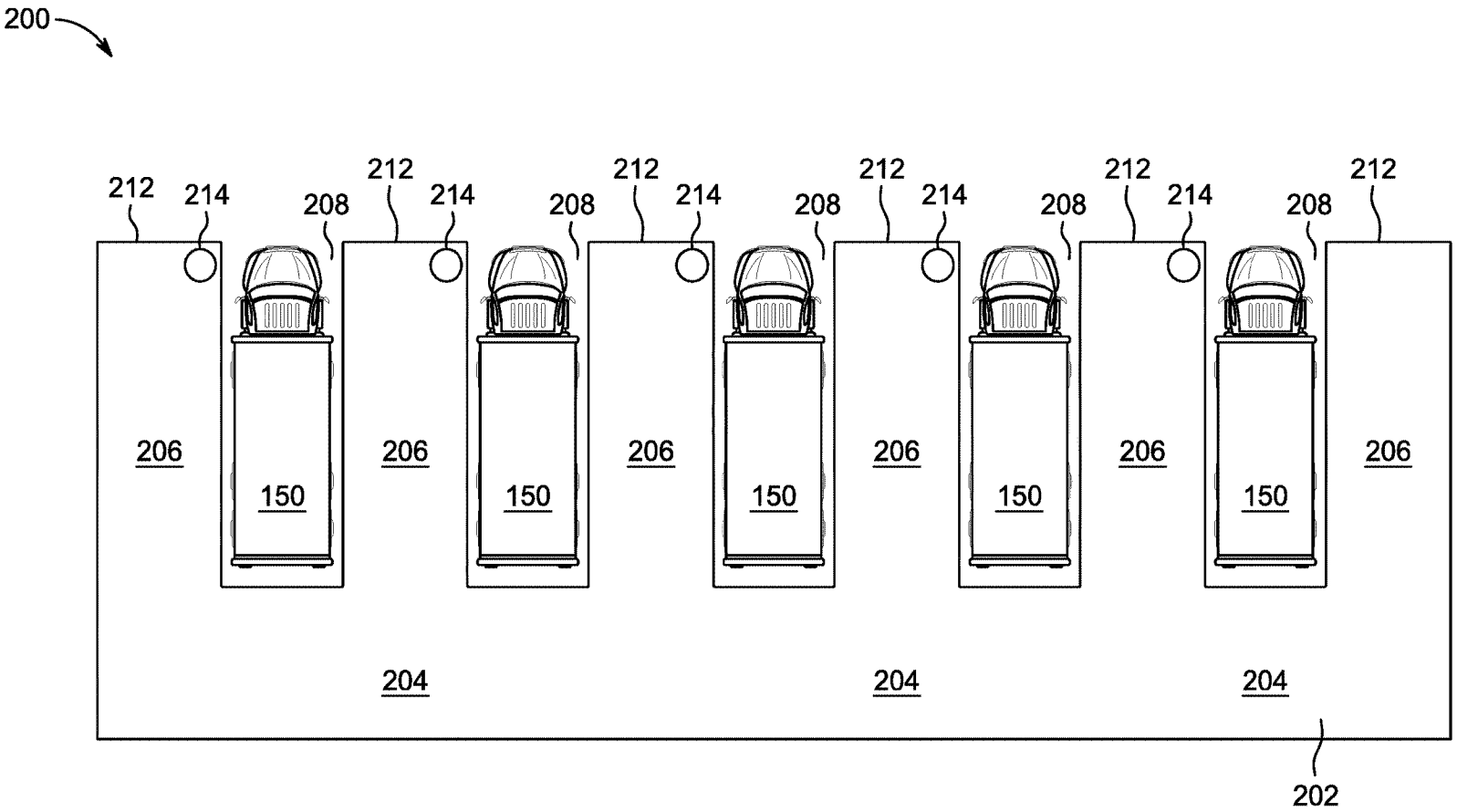
FIG. 2 depicts an outdoor food truck park according to an embodiment of the present disclosure.

Referring now to FIG. 2, there is depicted an outdoor food truck park 200 according to an embodiment of the present disclosure, where like reference numerals depict like components. The park 200 may comprises a walkway 202 having a main portion 204 and a plurality of extended pier portions 206 extending from the main portion 204. The main portion 204 may be substantially straight.

The park 200 may further comprise a parking area 210 for food trucks 150. The pier portions 206 may define a plurality of slips 208 in the parking area 210 for receiving food trucks 150. The pier portions 206 are raised with respect to the slips 208. Each of the extended pier portions 206 may terminate at a terminal end 212. Located adjacent each of the slips 208 is an electrical hookup 214 for providing electrical power to the food trucks 150.

Figure 3:
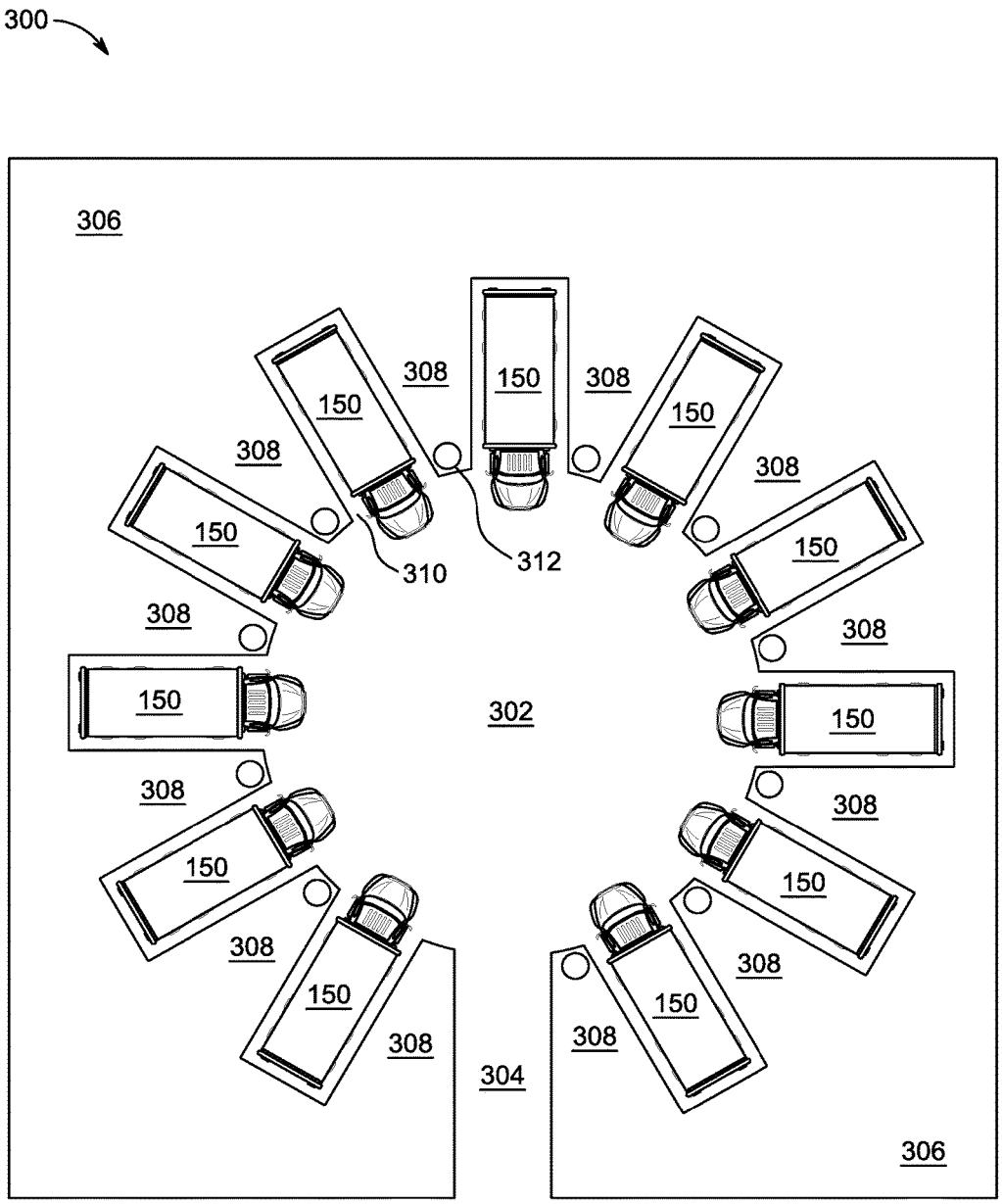
FIG. 3 depicts an outdoor food truck park according to an embodiment of the present disclosure.

Referring now to FIG. 3, there is depicted an outdoor food truck park 300 according to an embodiment of the present disclosure, where like reference numerals depict like components. The park 300 may comprise a parking area 302 for food trucks 150. A driveway 304 may connect the parking area 302 to a roadway (not shown). Disposed adjacent the parking area 302 is a pedestrian walkway 306. The walkway 306 comprises a plurality of extended pier portions 308. The extended pier portions 308 define a plurality of slips 310 configured and adapted for receiving the food trucks 150. Disposed adjacent the slips are electrical hookups 312 for providing onsite electrical hookups for the food trucks 150. The slips 310 are arranged in a hub and spoke configuration as shown in FIG. 3. The extended pier portions 308 are raised with respect to the slips 310. It will be appreciated that the slips 310 are arranged in a spoke and wheel configuration with the trucks 150 facing inwards.

Figure 4:
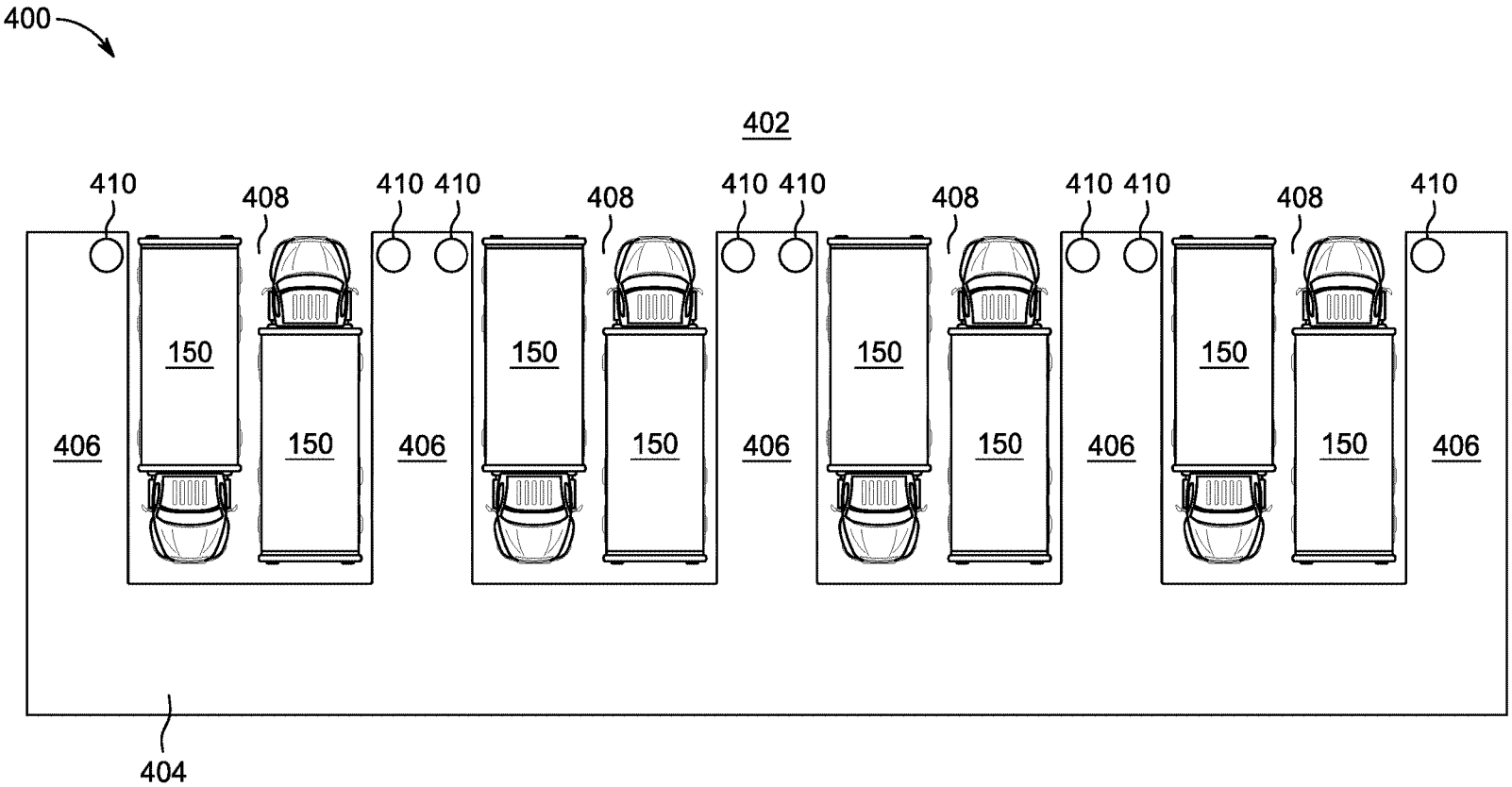
FIG. 4 depicts an outdoor food truck park according to an embodiment of the present disclosure.

Referring now to FIG. 4, there is depicted an outdoor food truck park 400 according to an embodiment of the present disclosure, where like reference numerals depict like components. The park 400 may comprise a parking area 402 for food trucks 150. Disposed adjacent the parking area 402 is a pedestrian walkway 404. The walkway 404 comprises a plurality of extended pier portions 406. The extended pier portions 406 define a plurality of slips 408 configured and adapted for receiving the food trucks 150. Disposed adjacent the slips are electrical hookups 410 for providing onsite electrical hookups for the food trucks 150. The slips 408 are doublewide in order to permit two food trucks to park next to each other—with one facing into the slip 408 and one facing outwards. The extended pier portions 406 are raised with respect to the slips 408.

Figure 5:
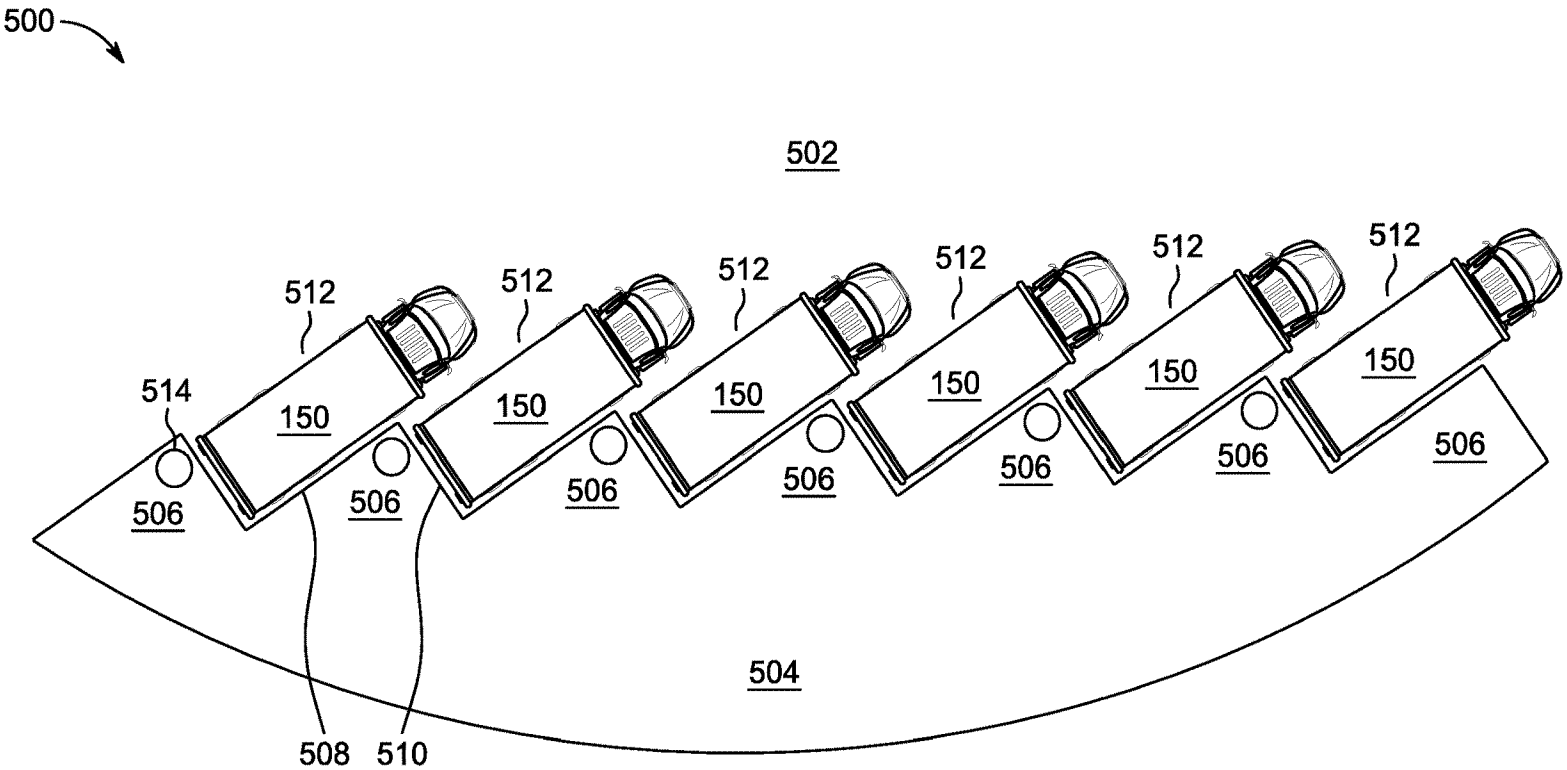
FIG. 5 depicts an outdoor food truck park according to an embodiment of the present disclosure.

Referring now to FIG. 5, there is depicted an outdoor food truck park 500 according to an embodiment of the present disclosure, where like reference numerals depict like components. The park 500 may comprise a parking area 502 for food trucks 150. Disposed adjacent the parking area 502 is a pedestrian walkway 504. The walkway 504 comprises a plurality of extended pier portions 506. The extended pier portions 506 define a plurality of slips 512 configured and adapted for receiving the food trucks 150. Disposed adjacent the slips are electrical hookups 514 for providing onsite electrical hookups for the food trucks 150. The extended pier portions 506 are raised with respect to the slips 512.

Each of the pier portions 506 may comprise a first side edge 508 and a second side edge 510. The first side edge 508 and the second side edge 510 intersect at an angle. In an embodiment, the angle is about 90 degrees. The first side edge 508 is longer than the second side edge 510. With the park 500 in operation, the first side edge 508 is disposed adjacent a side of a food truck while the second side edge 510 is disposed adjacent a back of a food truck 150. It will be appreciated that the slips 512 are arranged in a staggered configuration.

Figure 6:
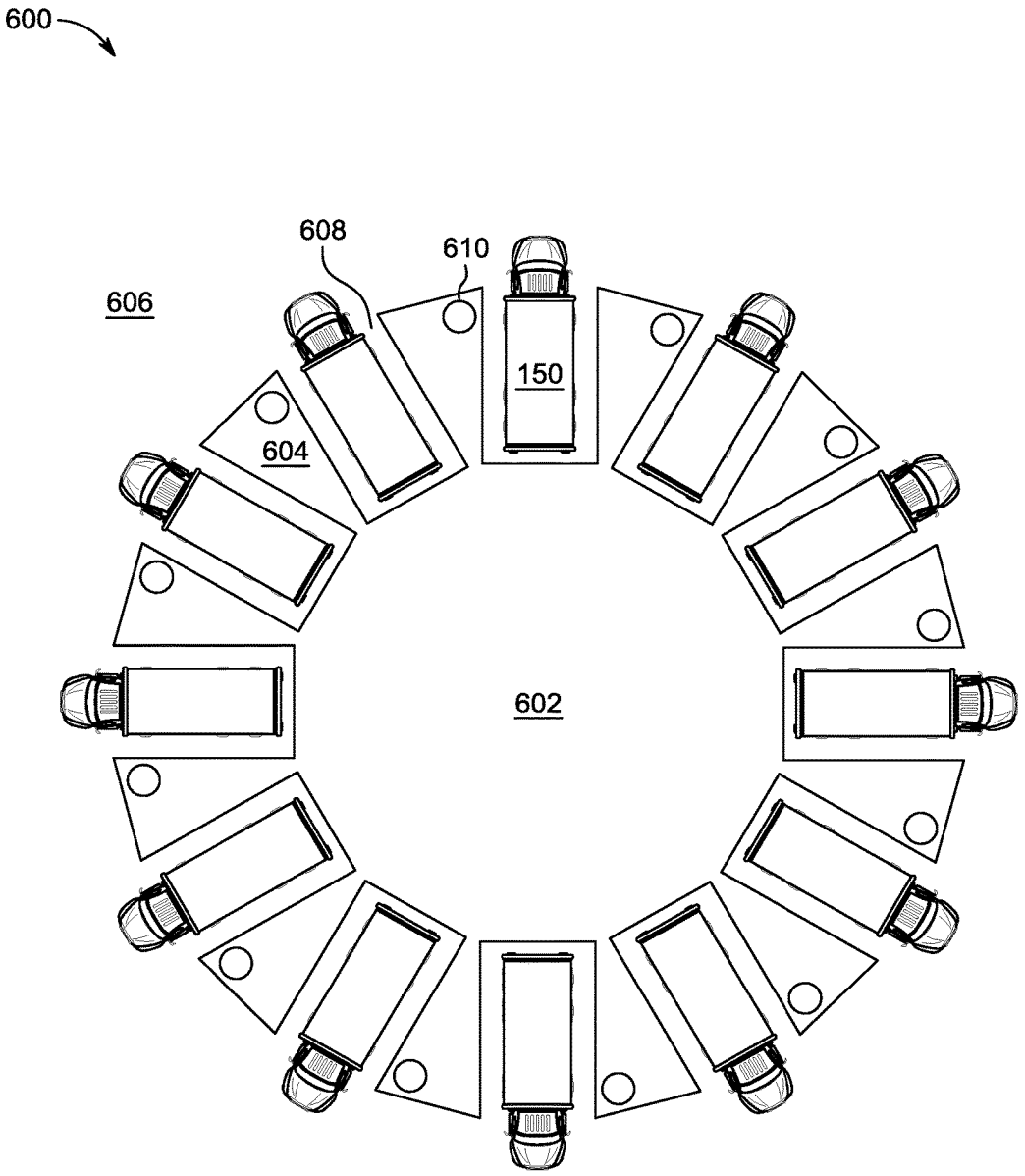
FIG. 6 depicts an outdoor food truck park according to an embodiment of the present disclosure.

Referring now to FIG. 6, there is depicted an outdoor food truck park 600 according to an embodiment of the present disclosure. The park 600 comprises a parking area 606 for food trucks 150. Disposed adjacent the parking area 606 is a pedestrian walkway 602. The pedestrian walkway 602 comprises a plurality of extended pier portions 604 that define slips 608 for the food trucks. The walkway 602 is raised with respect to the level of the slips 608. The park 600 may further comprise a plurality of electrical hookups 610. In particular, each of the slips 608 includes an electrical hookup 610 such that each of the trucks 150 may hookup to electrical power. It will be appreciated that the slips 608 are arranged in a spoke and wheel configuration with the trucks 150 facing outwards.

It will be appreciated that the present disclosure provides an outdoor food truck park for mobile food trucks, said outdoor food truck park comprising: a parking area for the mobile food trucks; a pedestrian walkway adjacent the parking area; the pedestrian walkway having a plurality of extended pier portions, each of the extended pier portions extending into the parking area; and the extended pier portions of the pedestrian walkway defining parking slips for the mobile food trucks; wherein the extended pier portions are raised with respect to a level of the parking slips.

It will be appreciated that the present disclosure provides an outdoor food truck park for mobile food trucks having a pedestrian walkway that is raised with respect to the parking slips for the mobile food trucks.

It will be appreciated that the present disclosure provides an outdoor food truck park for mobile food trucks with parking slips, wherein a width of each of the parking slips between adjacent ones of the extended pier portions permits only a single food truck.

It will be appreciated that the present disclosure provides an outdoor food truck park for mobile food trucks, wherein a width of each of the parking slips between adjacent ones of the extended pier portions permits only a pair of food trucks.

It will be appreciated that the present disclosure provides an outdoor food truck park for mobile food trucks that includes a plurality of electrical hookups for the food trucks.

It will be appreciated that the present disclosure provides an outdoor food truck park for mobile food trucks, wherein the parking slips are disposed in a spoke and wheel configuration.

It will be appreciated that the present disclosure provides an outdoor food truck park for mobile food trucks, further comprising mobile food trucks parked in the parking slips.

It will be appreciated that the present disclosure provides an outdoor food truck park for mobile food trucks and a method of operating the outdoor food truck park, said method comprising: providing a parking area for a plurality of mobile food trucks; and providing a pedestrian walkway adjacent the parking area, said pedestrian walkway comprising a plurality of extended pier portions, the plurality of extended pier portions defining a plurality of parking slips in the parking area for the mobile food trucks; wherein the extended pier portions are raised with respect to a level of the parking slips.

It will be appreciated that the present disclosure provides an outdoor food truck park for mobile food trucks comprising: a parking area for the mobile food trucks; a pedestrian walkway adjacent the parking area; the pedestrian walkway having a plurality of extended pier portions, each of the extended pier portions extending into the parking area; and the extended pier portions of the pedestrian walkway defining parking slips for the mobile food trucks; wherein the extended pier portions are raised with respect to a level of the parking slips; wherein the pedestrian walkway has an arcuate shape.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An outdoor food truck park for mobile food trucks, said outdoor food truck park comprising:

a parking area for the mobile food trucks;

a pedestrian walkway adjacent the parking area;

the pedestrian walkway having a plurality of extended pier portions, each of the extended pier portions extending into the parking area; and the extended pier portions of the pedestrian walkway defining parking slips for the mobile food trucks;

wherein the extended pier portions are raised with respect to the parking slips for the mobile food trucks;

wherein a width of each of the parking slips between adjacent ones of the extended pier portions permits only a single food truck;

wherein the pedestrian walkway has an arcuate shape with a concave side; and wherein the extended pier portions extend from the concave side of the pedestrian walkway.

2. The outdoor food truck park of claim 1, further comprising a plurality of electrical hookups for the food trucks.

3. The outdoor food truck park of claim 1, wherein the plurality of slips comprises at least four slips.

4. The outdoor food truck park of claim 1, further comprising mobile food trucks parked in the parking slips.

5. A method of operating an outdoor food park, said method comprising:

providing a parking area for a plurality of mobile food trucks; and providing a pedestrian walkway adjacent the parking area, said pedestrian walkway comprising a plurality of extended pier portions, the plurality of extended pier portions defining a plurality of parking slips in the parking area for the mobile food trucks;

wherein the extended pier portions are raised with respect to a level of the parking slips;

wherein the pedestrian walkway has an arcuate shape with a concave side;

wherein a width of each of the parking slips between adjacent ones of the extended pier portions permits only a single food truck; and wherein the extended pier portions extend from the concave side of the pedestrian walkway.

6. The method of claim 5, further comprising providing a plurality of electrical hookups for the food trucks adjacent the parking slips.

7. The method of claim 5, further comprising parking the mobile food trucks in the parking slips.

8. The method of claim 5, wherein the plurality of parking slips comprises at least four parking slips.

9. An outdoor food truck park for mobile food trucks, said outdoor food truck park comprising:

a parking area for the mobile food trucks;

a pedestrian walkway adjacent the parking area;

the pedestrian walkway having a plurality of extended pier portions, each of the extended pier portions extending into the parking area; and the extended pier portions of the pedestrian walkway defining parking slips for the mobile food trucks;

wherein the extended pier portions are raised with respect to a level of the parking slips;

wherein the pedestrian walkway has an arcuate shape;

wherein an edge of the pedestrian walkway defines a concave side;

wherein the extended pier portions extend from the concave side of the pedestrian walkway;

wherein the extended pier portions are tapered;

wherein the parking slips defined by extended pier portions are configured to allow pull-in or back-in of food trucks such that the trucks are bounded on three sides by the pedestrian walkway.

10. The outdoor food truck park of claim 9, further comprising a plurality of electrical hookups for mobile food trucks, each of the plurality of electrical hookups being disposed adjacent one of the plurality of parking slips.

11. The outdoor food truck park of claim 9, wherein a width between adjacent ones of the extended pier portions allow only a single food truck to park therebetween.

* * * * *